US009658589B2

(12) United States Patent
Chiba et al.

(10) Patent No.: US 9,658,589 B2
(45) Date of Patent: May 23, 2017

(54) TRANSPORTING DEVICE, FIXING DEVICE, AND IMAGE FORMING APPARATUS

(71) Applicant: FUJI XEROX Co., Ltd., Tokyo (JP)

(72) Inventors: Takahito Chiba, Kanagawa (JP); Tsuyoshi Sunohara, Kanagawa (JP); Hidehiko Yamaguchi, Kanagawa (JP); Hideki Moriya, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/018,021

(22) Filed: Feb. 8, 2016

(65) Prior Publication Data

US 2017/0075275 A1 Mar. 16, 2017

(30) Foreign Application Priority Data

Sep. 15, 2015 (JP) ..... 2015-182317

(51) Int. Cl.
*G03G 15/00* (2006.01)

(52) U.S. Cl.
CPC ..... *G03G 15/5062* (2013.01)

(58) Field of Classification Search
CPC ..... G03G 15/5029; G03G 2215/00738; G03G 15/5062
USPC ..... 399/12
See application file for complete search history.

(56) References Cited

U.S. PATENT DOCUMENTS 5,600,424 A * 2/1997 Malachowski .... G03G 15/2064 399/396
6,393,334 B1 * 5/2002 Lewis ..... G05B 19/41865 700/114
2008/0175612 A1 * 7/2008 Oikawa ..... G03G 15/161 399/66
2008/0199196 A1 * 8/2008 Cook ..... G03G 15/1675 399/66
2015/0153689 A1 * 6/2015 Russel ..... G03G 15/2028 399/68
2015/0301494 A1 * 10/2015 Kitabayashi ..... G03G 15/161 399/71

FOREIGN PATENT DOCUMENTS

JP 05066627 A * 3/1993
JP 2004-018127 A 1/2004
JP 2013-189260 A 9/2013

* cited by examiner

*Primary Examiner* — Gregory H Curran
(74) *Attorney, Agent, or Firm* — Oliff PLC

(57) ABSTRACT

A transporting device includes a detecting portion that detects a load applied to a driving portion provided for transporting a medium, an identifying portion that identifies a type of the medium from a result of detection performed by the detecting portion, and a correcting portion that fits, if a predetermined instruction is made, the result of detection to a predetermined reference characteristic of the load applied to the driving portion.

9 Claims, 4 Drawing Sheets

TRANSPORTING DEVICE, FIXING DEVICE, AND IMAGE FORMING APPARATUS

CROSS-REFERENCE TO RELATED APPLICATIONS

This application is based on and claims priority under 35 USC 119 from Japanese Patent Application No. 2015-182317 filed Sep. 15, 2015.

BACKGROUND

Technical Field

The present invention relates to a transporting device, a fixing device, and an image forming apparatus.

SUMMARY

According to an aspect of the invention, there is provided a transporting device including a detecting portion that detects a load applied to a driving portion provided for transporting a medium, an identifying portion that identifies a type of the medium from a result of detection performed by the detecting portion, and a correcting portion that fits, if a predetermined instruction is made, the result of detection to a predetermined reference characteristic of the load applied to the driving portion.

BRIEF DESCRIPTION OF THE DRAWINGS

An exemplary embodiment of the present invention will be described in detail based on the following figures, wherein.

DETAILED DESCRIPTION

Figure 1:
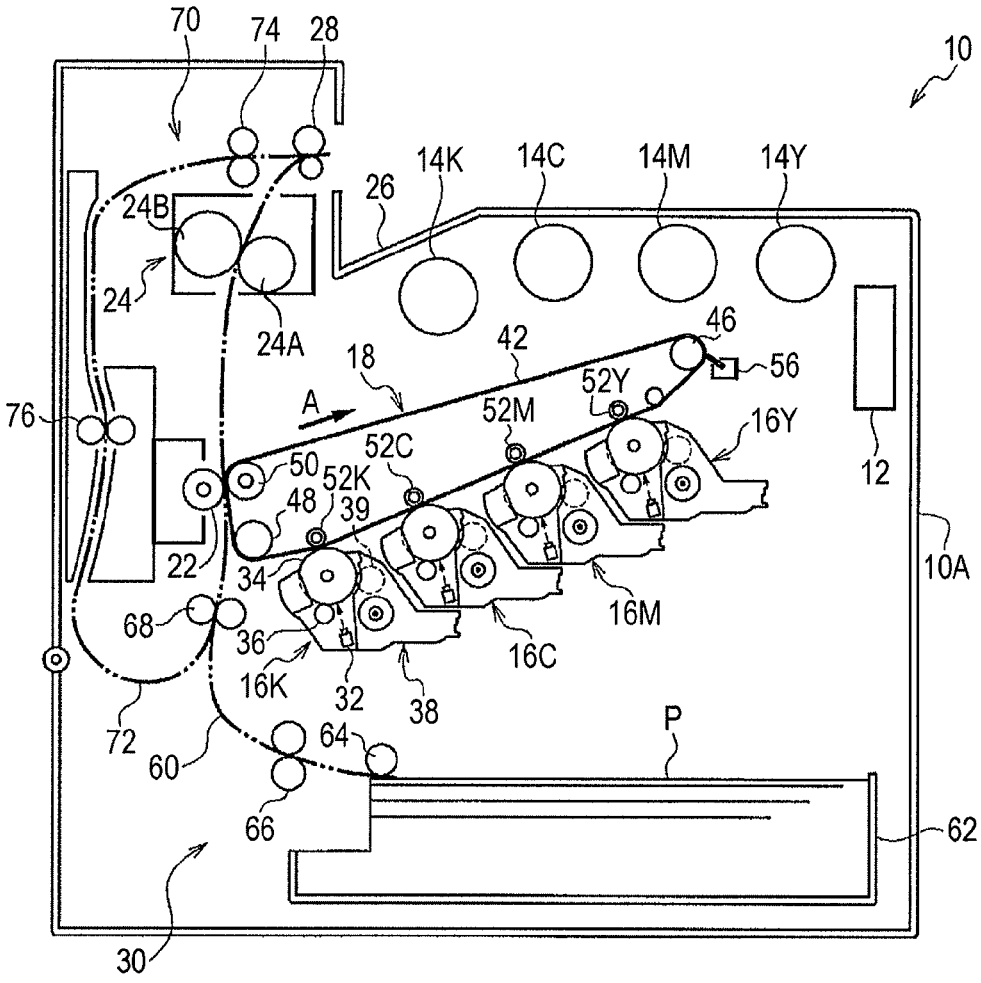
FIG. 1 illustrates an outline configuration of an image forming apparatus according to the exemplary embodiment.

FIG. 1 illustrates an outline configuration of an image forming apparatus 10 according to an exemplary embodiment of the present invention.

Referring to FIG. 1, the configuration of the image forming apparatus 10 according to the present exemplary embodiment will first be described. Hereinafter, yellow is denoted by Y, magenta is denoted by M, cyan is denoted by C, and black is denoted by K. Furthermore, elements and toner images (or images) that need to be distinguished from one another by the above colors are denoted by reference numerals with suffixes Y, M, C, and K representing the above colors, respectively. If such elements or toner images are denoted collectively regardless of the colors, the suffixes given to the reference numerals are omitted.

Overall Configuration

Referring to FIG. 1, the image forming apparatus 10 has an apparatus body 10A, in which an image processing portion 12 is provided. The image processing portion 12 processes image data inputted thereto into pieces of gray-scale data for the four respective colors Y, M, C, and K.

The apparatus body 10A further includes the following elements. Image forming units 16 as exemplary image forming portions that form toner images in the respective colors are provided in a central part of the apparatus body 10A and are arranged at intervals in a direction that is at an angle with respect to the horizontal direction. A first transfer unit 18 is provided above the image forming units 16. The toner images formed by the respective image forming units 16 are transferred to the first transfer unit 18 in such a manner as to be superposed one on top of another.

A second transfer roller 22 is provided on one side (the left side in FIG. 1) of the first transfer unit 18. The second transfer roller 22 transfers the toner images superposed on the first transfer unit 18 to a sheet P as an exemplary medium that is transported along a transport path 60 by a feed-and-transport unit 30 to be described later.

A fixing device 24 as an exemplary transporting device that nips and transports the sheet P is provided on the downstream side with respect to the second transfer roller 22 in a direction in which the sheet P is transported (hereinafter, the direction is referred to as "sheet transporting direction"). The fixing device 24 fixes the toner images on the sheet P with heat and pressure.

The fixing device 24 according to the present exemplary embodiment includes a heating belt 24A and a pressing roller 24B that are a pair of rotating bodies. The fixing device 24 is a so-called induction-heating (IH) fixing device in which the heating belt 24A is caused to generate heat by the effect of electromagnetic induction. The pressing roller 24B is driven (rotated) by a motor 112 (see FIG. 2) as an exemplary driving portion. The heating belt 24A rotates by following the rotation of the pressing roller 24B.

A pair of discharge rollers 28 are provided on the downstream side with respect to the fixing device 24 in the sheet transporting direction. The pair of discharge rollers 28 discharges the sheet P having the fixed toner images to an output portion 26 provided at the top of the apparatus body 10A of the image forming apparatus 10.

The feed-and-transport unit 30 that feeds and transports the sheet P lies below the image forming units 16 and extends to and along one side of the image forming units 16. Four toner cartridges 14 (14K, 14C, 14M, and 14Y) filled with respective toners to be supplied to respective developing devices 38 are provided above the first transfer unit 18. The toner cartridges 14 are attachable to and detachable from the apparatus body 10A from the front side of the apparatus body 10A and are arranged side by side in the width direction of the image forming apparatus 10. The toner cartridges 14 for the respective colors each have a columnar shape extending in the depth direction of the image forming apparatus 10 and are each connected to the respective developing devices 38 with respective supply tubes (not illustrated).

Image Forming Units

As illustrated in FIG. 1, the image forming units 16 for the respective colors all have the same configuration. Each of the image forming units 16 includes a round-columnar rotating image carrier 34, and a charger 36 that charges the surface of the image carrier 34.

The image forming unit 16 further includes a light-emitting-diode (LED) head 32 that forms an electrostatic latent image on the charged surface of the image carrier 34 by applying an exposure beam thereto, the developing device 38 that develops and visualizes the electrostatic latent image into a toner image by using a developer (in the present exemplary embodiment, a negatively charged toner), and a cleaning blade (not illustrated) that cleans the surface of the image carrier 34.

The developing device 38 includes a developing roller 39 provided facing the image carrier 34. The electrostatic latent image formed on the image carrier 34 is developed with the developer by the developing roller 39 and is thus visualized as a toner image.

The charger 36, the LED head 32, the developing roller 39, and the cleaning blade are arranged along the surface of the image carrier 34 in that order from the upstream side toward the downstream side in the direction of rotation of the image carrier 34.

Transfer Portions (First Transfer Unit and Second Transfer Roller)

The first transfer unit 18 includes an endless intermediate transfer belt 42, a driving roller 46, a tension applying roller 48, an assisting roller 50, and first transfer rollers 52. The intermediate transfer belt 42 is stretched around the driving roller 46, the tension applying roller 48, the assisting roller 50, and the first transfer rollers 52. The driving roller 46 is rotated when driven by a motor (not illustrated) and thus rotates the intermediate transfer belt 42 in a direction of an arrow A. The tension applying roller 48 applies tension to the intermediate transfer belt 42. The assisting roller 50 is provided above the tension applying roller 48 and rotates by following the rotation of the intermediate transfer belt 42. The first transfer rollers 52 are provided across the intermediate transfer belt 42 from the respective image carriers 34.

In the above configuration, toner images in the respective colors Y, M, C, and K that are formed on the image carriers 34 of the respective image forming units 16 are transferred to the intermediate transfer belt 42 by the respective first transfer rollers 52 in such a manner as to be superposed one on top of another.

A cleaning blade 56 that cleans the surface of the intermediate transfer belt 42 by being in contact therewith is provided across the intermediate transfer belt 42 from the driving roller 46.

The second transfer roller 22 that transfers the toner images on the intermediate transfer belt 42 to the sheet P that is transported thereto is provided across the intermediate transfer belt 42 from the assisting roller 50. The second transfer roller 22 is grounded. The assisting roller 50 serves as a counter electrode for the second transfer roller 22. A second transfer voltage is applied to the assisting roller 50, whereby the toner images are transferred to the sheet P. In the present exemplary embodiment, for example, the speed of transport of the sheet P by the second transfer roller 22 and the intermediate transfer belt 42 is faster than the speed of transport of the sheet P by the fixing device 24.

Feed-and-Transport Unit

The feed-and-transport unit 30 provided in the apparatus body 10A includes a sheet container 62 provided below the image forming units 16. Plural sheets P are contained in the sheet container 62.

The feed-and-transport unit 30 further includes a feed roller 64, a pair of separating rollers 66, and a pair of registration rollers 68 that are arranged in that order from the upstream side toward the downstream side in the sheet transporting direction. The feed roller 64 feeds some of the sheets P contained in the sheet container 62 into the transport path 60. The pair of separating rollers 66 separate one of the sheets P fed by the feed roller 64 from the others. The pair of registration rollers 68 adjust the timing of transporting the sheet P.

The pair of registration rollers 68 are connected to a motor (not illustrated) that drives and thus rotates the pair of registration rollers 68 with a clutch mechanism (not illustrated) interposed therebetween. In the image forming apparatus 10, the clutch mechanism is disconnected from the pair of registration rollers 68 until the sheet P reaches the pair of registration rollers 68. Therefore, the leading end of the sheet P in the sheet transporting direction knocks against the pair of registration rollers 68. Thus, in the image forming apparatus 10, any tilt of the sheet P with respect to the sheet transporting direction is corrected; that is, the sheet P is registered. After the sheet P is registered, the pair of registration rollers 68 are connected to the clutch mechanism and are rotated. Thus, the sheet P is transported.

In the above configuration, the sheet P fed from the sheet container 62 is transported by the pair of rotating registration rollers 68 at a predetermined timing to a portion (second transfer position) where the intermediate transfer belt 42 and the second transfer roller 22 are in contact with each other.

The sheet P is then transported to the fixing device 24, where the sheet P is heated by the heating belt 24A and is pressed between the heating belt 24A and the pressing roller 24B, whereby the toner images on one side (an image forming side) of the sheet P are fixed.

The feed-and-transport unit 30 further includes a duplex transporting device 70 that is used before the sheet P on one side of which the toner images have been fixed by the fixing device 24 is discharged onto the output portion 26 by the pair of discharge rollers 28 and if other toner images are formed on the other side of the sheet P.

The duplex transporting device 70 includes a duplex transport path 72 in which the sheet P is turned over by being transported from the pair of discharge rollers 28 to the pair of registration rollers 68, and pairs of transport rollers 74 and 76 that transport the sheet P along the duplex transport path 72.

The image forming apparatus 10 may include a sheet identifying sensor provided on at least one of the upstream side and the downstream side with respect to the fixing device 24 on the transport path 60. The sheet identifying sensor may be, for example, a reflection-type sensor including a pair of light-emitting element and a light-receiving element. In that case, the sheet identifying sensor applies light from the light-emitting element to an identifying position on the transport path 60 that corresponds to the position where the light-receiving element is provided. The sheet identifying sensor outputs a signal (hereinafter referred to as "identifying signal") at a level corresponding to the quantity of light received by the light-receiving element. While the sheet P is being transported over the identifying position, the light emitted from the light-emitting element is reflected by the sheet P. Hence, the level of the identifying signal that is outputted by the sheet identifying sensor is different between that outputted while the sheet P is being transported over the identifying position and that outputted while no sheet P is being transported over the identifying position. The sheet identifying sensor may be any other sensor such as a transmission-type sensor, instead of the above reflection-type sensor.

Image Forming Process

First, the image processing portion 12 outputs pieces of gray-scale data for the respective colors to the respective LED heads 32. The LED heads 32 emit exposure beams in accordance with the pieces of gray-scale data, respectively. The exposure beams are applied to the surfaces of the image carriers 34 that are charged by the chargers 36, respectively, whereby electrostatic latent images are formed on the surfaces of the image carriers 34, respectively. The electrostatic latent images on the image carriers 34 are developed by the developing devices 38 and are thus visualized as toner images in the colors Y, M, C, and K, respectively.

The toner images in the respective colors on the image carriers 34 are transferred to the rotating intermediate transfer belt 42 by the first transfer rollers 52 of the first transfer unit 18 in such a manner as to be superposed one on top of another.

The toner images in the respective colors superposed on the intermediate transfer belt 42 are transferred by the second transfer roller 22 at the second transfer position to a sheet P transported thereto from the sheet container 62 along the transport path 60 by the feed roller 64, the pair of separating rollers 66, and the pair of registration rollers 68.

The sheet P now having the toner images is transported to the fixing device 24, and the toner images are fixed to the sheet P by the fixing device 24. The sheet P now having the fixed toner images is discharged to the output portion 26 by the pair of discharge rollers 28.

If images are to be formed on both sides of the sheet P, the sheet P having the toner images fixed to one side (front side) thereof by the fixing device 24 is not discharged to the output portion 26 by the pair of discharge rollers 28. The pair of discharge rollers 28 rotate backward, whereby the direction of transport of the sheet P is changed. Thus, the sheet P is transported along the duplex transport path 72 by the pairs of transport rollers 74 and 76.

The sheet P is turned over by being transported along the duplex transport path 72 and reaches the pair of registration rollers 68 again. Subsequently, other toner images are transferred to the other side (back side) of the sheet P and are fixed. Then, the sheet P is discharged to the output portion 26 by the pair of discharge rollers 28.

Figure 2:
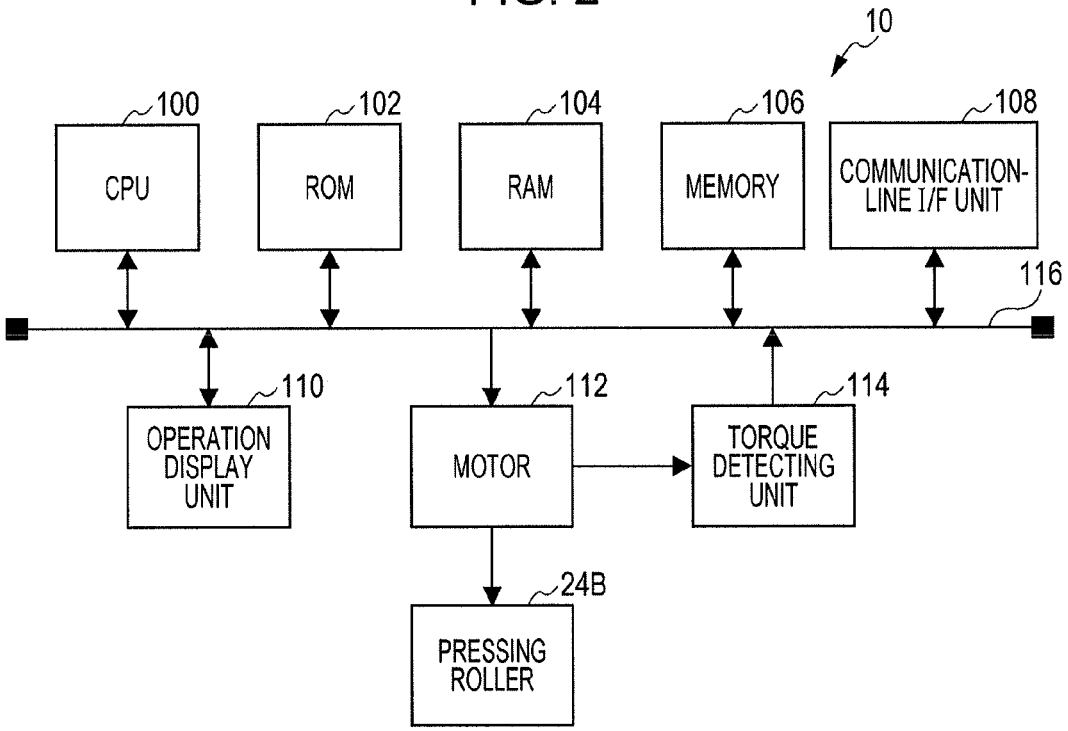
FIG. 2 is a block diagram illustrating relevant elements included in an electrical system of the image forming apparatus according to the exemplary embodiment.

Referring now to FIG. 2, relevant elements included in an electrical system of the image forming apparatus 10 according to the present exemplary embodiment will be described. FIG. 2 is a block diagram illustrating relevant elements included in the electrical system of the image forming apparatus 10 according to the present exemplary embodiment.

As illustrated in FIG. 2, the image forming apparatus 10 according to the present exemplary embodiment includes a central processing unit (CPU) 100 that controls the entire operation of the image forming apparatus 10, a read-only memory (ROM) 102 that originally stores associated information such as programs and parameters, a random access memory (RAM) 104 that is used as a work area or the like when any programs are executed by the CPU 100, and a nonvolatile memory 106 such as a flash memory.

The image forming apparatus 10 further includes a communication-line interface (I/F) unit 108 that transmits and receives communication data to and from external apparatuses, and an operation display unit 110 that accepts instructions made to the image forming apparatus 10 by a user and displays associated information such as the operational status of the image forming apparatus 10 to the user. The operation display unit 110 includes, for example, a display with a touch panel on which associated pieces of information and buttons for accepting operational instructions are displayed when any program is executed, and a hardware keyboard including a numerical keypad and a start button.

The image forming apparatus 10 further includes a torque detecting unit 114 as an exemplary detecting portion that detects the load (torque) applied to the motor 112 that drives the pressing roller 24B to rotate. The torque detecting unit 114 according to the present exemplary embodiment is connected to the motor 112 and detects the torque of the motor 112 as the value of a current flowing through the motor 112.

The configuration of the torque detecting unit 114 according to the present exemplary embodiment is not specifically limited, as long as the torque detecting unit 114 is capable of detecting the torque of the motor 112. For example, the torque detecting unit 114 may be any of the following: a unit that detects the torque of the motor 112 as the value of a current flowing through the motor 112 and outputs a voltage value obtained by converting the detected current value, a unit that detects the current by measuring the voltage between shunt resistors, a unit that detects the current by measuring the voltage between resistors that are provided on a path of the current flowing through the motor 112, a unit that detects the current by using a current sensor including a Hall device and provided on a path of the current flowing through the motor 112, and a torque detector that detects the torque of the motor 112.

The CPU 100, the ROM 102, the RAM 104, the memory 106, the communication-line I/F unit 108, the operation display unit 110, the motor 112, and the torque detecting unit 114 are connected to one another by being connected to a bus 116 including an address bus, a data bus, a control bus, and the like.

The CPU 100 of the image forming apparatus 10 according to the present exemplary embodiment that is configured as described above allows access to the ROM 102, the RAM 104, and the memory 106 and transmission and reception of communication data to and from external apparatuses via the communication-line I/F unit 108. Furthermore, the CPU 100 of the image forming apparatus 10 acquires information on associated instructions made on the operation display unit 110 and displays such information on the operation display unit 110. Furthermore, the CPU 100 of the image forming apparatus 10 controls the motor 112 and acquires the voltage value outputted from the torque detecting unit 114.

The image forming apparatus 10 according to the present exemplary embodiment has an identifying function in which the type of the sheet P is identified. The identifying function will now be described.

Figure 3:
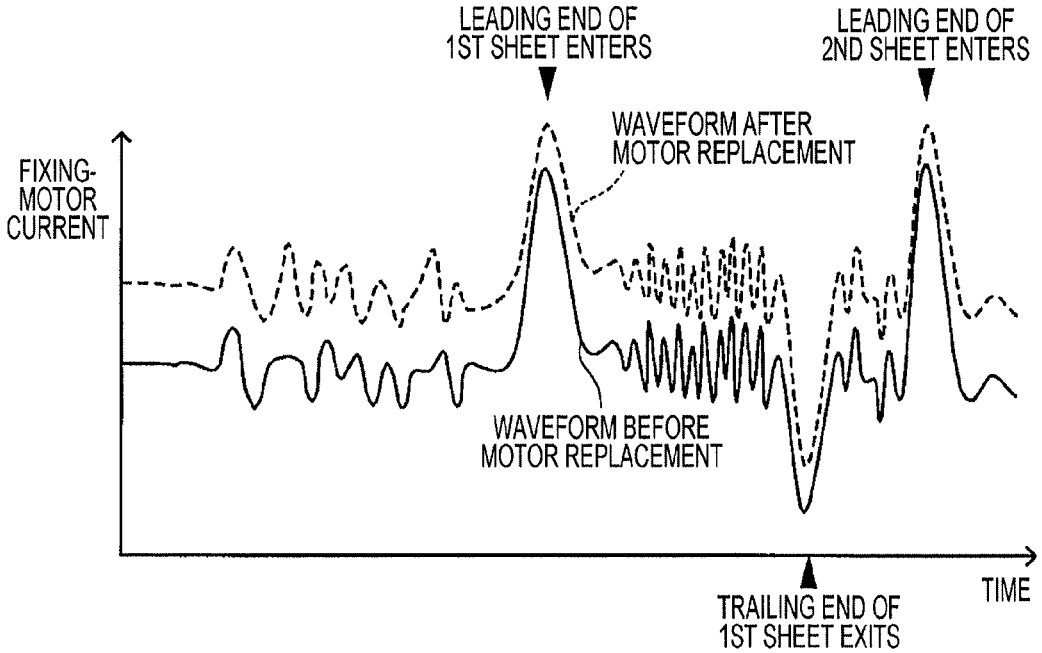
FIG. 3 is a graph of exemplary currents detected by a torque detecting unit before and after motor replacement.

Referring to FIG. 3, when the sheet P enters the fixing device 24, the current value detected by the torque detecting unit 114 rapidly increases, whereby an upward peak appears. Subsequently, when the sheet P exits from the fixing device 24, the current value rapidly decreases, whereby a downward peak appears. The current values detected by the torque detecting unit 114, including the peak detected when the sheet P enters the fixing device 24, the peak detected when the sheet P exits from the fixing device 24, and the value detected while the sheet P is passing through the fixing device 24, vary with the type (thickness) of the sheet P. In the identifying function according to the present exemplary embodiment, the fact that the current detected by the torque detecting unit 114 varies with the type of the sheet P is utilized. The CPU 100 identifies the type of the sheet P by acquiring the result of the detection by the torque detecting unit 114.

In such an identifying function, if the motor 112 is replaced with a new one at the time of an incident such as a malfunction or quality deterioration, the characteristic of the motor 112 may change, as represented by the dotted line in the graph illustrated in FIG. 3, because of the variation among individual motors 112. In such an event, the type of the sheet P may be misidentified.

To avoid such a situation, in the present exemplary embodiment, when the motor 112 is replaced with a new one, a correcting process is performed in which the characteristic of the new motor 112 is fitted to the characteristic observed before the replacement.

Specifically, the correcting process is performed on the basis of a pre-stored characteristic of the motor 112 that is calculated from the results of detection by the torque detecting unit 114, including the torque with no sheet P that is detected before the sheet P reaches the fixing device 24, and the torque detected during a period from when the sheet P enters the fixing device 24 until when the sheet P is discharged from the fixing device 24.

Figure 4A:
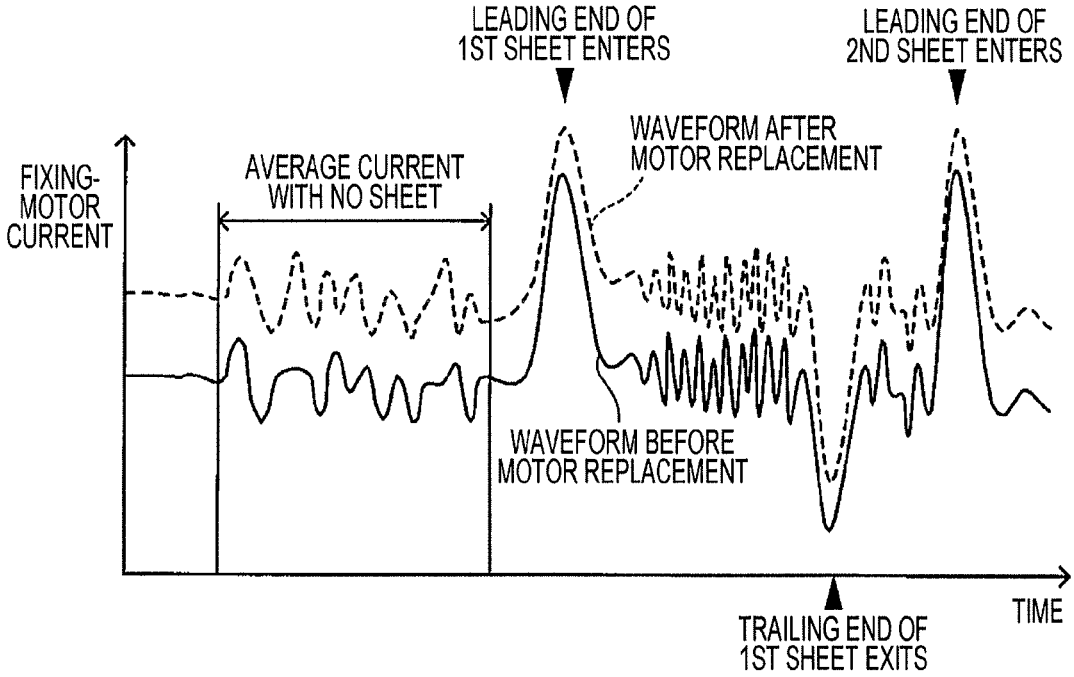
FIG. 4A is another graph of exemplary currents detected by the torque detecting unit before and after motor replacement, focusing on a part representing the average current with no sheet.
Figure 4B:
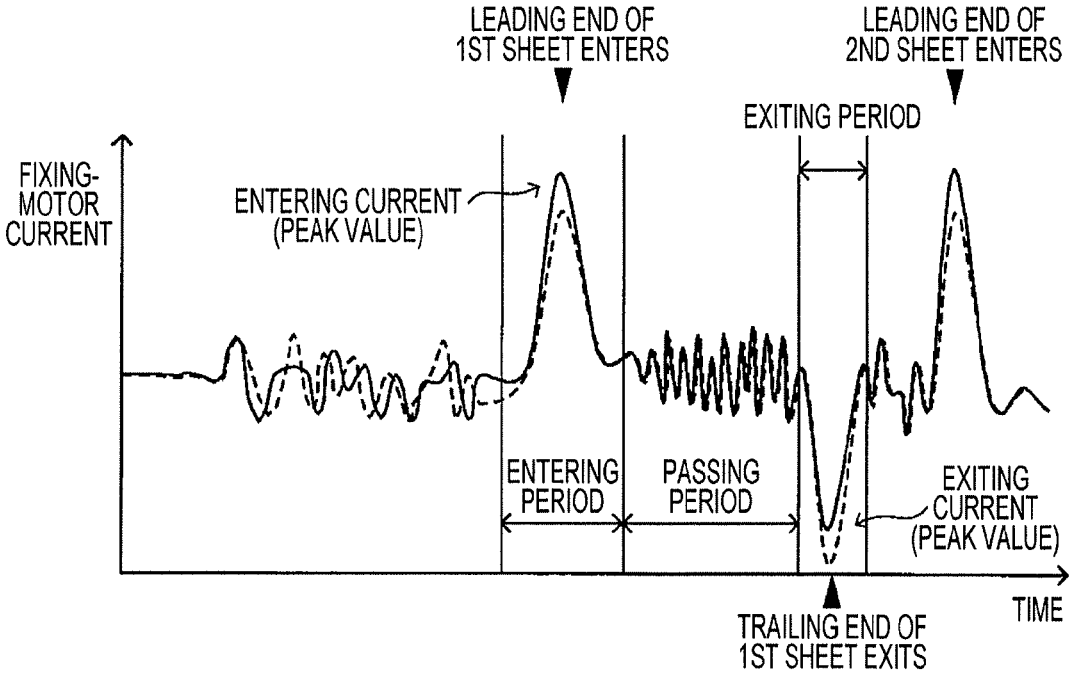
FIG. 4B is yet another graph of exemplary currents detected by the torque detecting unit before and after motor replacement, focusing on parts representing an entering current, an exiting current, an entering period, a passing period, and an exiting period.

The characteristic to be detected may be, for example, the average of the values detected by the torque detecting unit 114 before the sheet P reaches the fixing device 24 ("average current with no sheet" in FIG. 4A). Moreover, any of the following may additionally be taken into consideration for the determination of the characteristic: the peak value detected by the torque detecting unit 114 when the sheet P enters the fixing device 24 ("entering current" in FIG. 4B), the peak value detected by the torque detecting unit 114 when the sheet P exits from the fixing device 24 ("exiting current" in FIG. 4B), an entering period over which the entering of the sheet P into the fixing device 24 is detected, a passing period over which the sheet P passes through the fixing device 24, and an exiting period over which the exiting of the sheet P from the fixing device 24 is detected. In the following description of the present exemplary embodiment, all of the above items are taken into consideration for the determination of the characteristic of the motor 112. While the present exemplary embodiment concerns a case where the peak value refers to the largest or smallest value that forms the peak of the graph, the present invention is not limited to such a case. A value close to the peak value may be taken. Such a value is also regarded as the peak value in the present exemplary embodiment. The peak value of the current may be obtained within a certain current-sampling period (sampling rate).

When the motor 112 is replaced with a new one, the pre-stored characteristic is read and the torque detecting unit 114 detects the current of the new motor 112 while the sheet P is transported.

Then, the average current of the new motor 112 with no sheet P, i.e., the average of current values of the new motor 112 that are detected before the sheet P reaches the fixing device 24, is calculated, and a correction factor that fits the average current of the new motor 112 to the average current of the old motor 112 is calculated.

Furthermore, the entering current of the new motor 112 that is detected when the sheet P enters the fixing device 24 is obtained, and a correction factor that fits the entering current of the new motor 112 to the entering current of the old motor 112 is calculated.

Furthermore, the exiting current of the new motor 112 that is detected when the sheet P exits from the fixing device 24 is obtained, and a correction factor that fits the exiting current of the new motor 112 to the exiting current of the old motor 112 is calculated.

Furthermore, the periods of time (the entering period, the passing period, and the exiting period) over which the entering, the passing, and the exiting of the sheet P into, through, and from the fixing device 24 equipped with the new motor 112 are detected are calculated, and correction factors that fit the above periods to the respective periods observed with the old motor 112 are calculated.

Then, the above results of detection by the torque detecting unit 114 that are obtained with the new motor 112 are corrected on the basis of the above correction factors. Thus, the difference between the characteristic of the old motor 112 and the characteristic of the new motor 112 is reduced.

Figure 5:
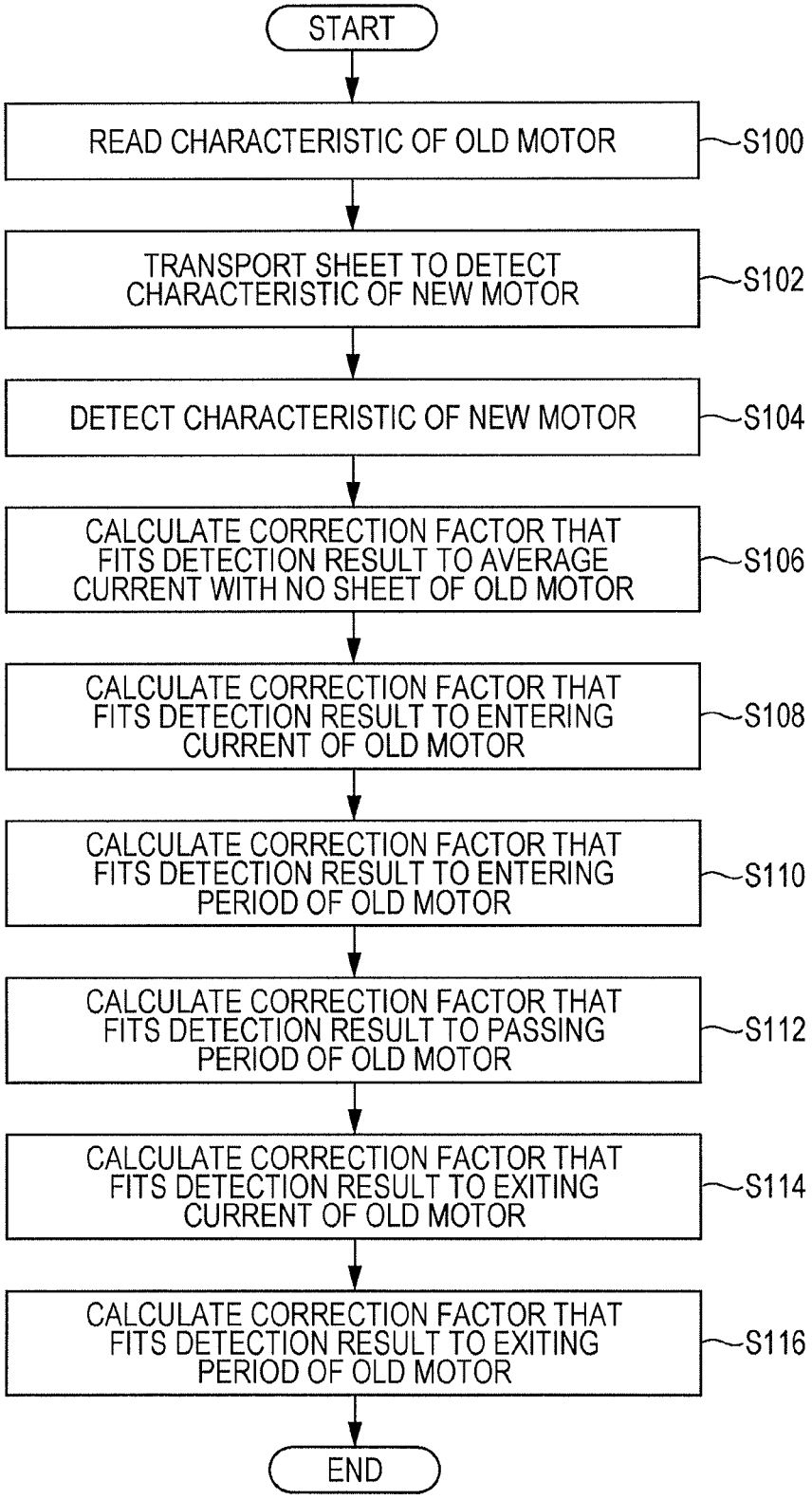
FIG. 5 is a flow chart illustrating an exemplary correcting process performed in the image forming apparatus according to the exemplary embodiment.

Now, the correcting process performed when the above motor 112 of the fixing device 24 of the image forming apparatus 10 according to the present exemplary embodiment is replaced with a new one will be described more specifically. FIG. 5 is a flow chart illustrating an exemplary correcting process performed in the image forming apparatus 10 according to the present exemplary embodiment. The correcting process illustrated in FIG. 5 is started as follows. When the operation display unit 110 is operated after the motor 112 is replaced with a new one, an instruction indicating the replacement of the motor 112 is displayed. Then, the CPU 100 executes a transport program stored in the ROM 102.

In step S100, the CPU 100 reads the characteristic of the old motor 112 that has been stored in the memory 106 before the replacement, and the process proceeds to step S102. The characteristic that is read in step S100 includes the average current with no sheet P indicated in FIG. 4A, and the entering current, the exiting current, the entering period, the passing period, and the exiting period indicated in FIG. 4B. While the present exemplary embodiment concerns a case where the characteristic is calculated and stored in advance, the present invention is not limited to such a case. For example, a set of values that are detected by the torque detecting unit 114 during a period from when the sheet P is yet to reach the fixing device 24 until when the sheet P is discharged from the fixing device 24 may be stored in advance, and the characteristic of the motor 112 may be calculated when the correcting process is executed.

In step S102, the CPU 100 controls the new motor 112 and associated elements to transport the sheet P for the purpose of calculating the characteristic of the new motor 112. Then, the process proceeds to step S104. That is, the sheet P is transported so that the characteristic of the new motor 112 that corresponds to the characteristic that has been read in step S100 is calculated.

In step S104, the CPU 100 causes the torque detecting unit 114 to detect the items representing the characteristic of the new motor 112, and the process proceeds to step S106. That is, the characteristic of the new motor 112 is calculated from the results of detection by the torque detecting unit 114, including the average current with no sheet P, the entering current, the exiting current, the entering period, the passing period, and the exiting period.

In step S106, the CPU 100 calculates a correction factor that fits the average current with no sheet P of the new motor 112 to the average current with no sheet P of the old motor 112. Then, the process proceeds to step S108.

In step S108, the CPU 100 calculates a correction factor that fits the entering current of the new motor 112 to the entering current of the old motor 112. Then, the process proceeds to step S110.

In step S110, the CPU 100 calculates a correction factor that fits the entering period of the new motor 112 to the entering period of the old motor 112. Then, the process proceeds to step S112. The entering period, which is obtained when the entering current (the peak value observed when the sheet P enters the fixing device 24) is detected, is calculated as the sum of the period of time taken for the average current with no sheet P to rise to the entering current and the period of time taken for the entering current to drop to the average of current values detected while the sheet P is passing through the fixing device 24 (hereinafter referred to as "average current with the sheet P").

In step S112, the CPU 100 calculates a correction factor that fits the passing period of the new motor 112 to the passing period of the old motor 112. Then, the process proceeds to step S114.

In step S114, the CPU 100 calculates a correction factor that fits the exiting current of the new motor 112 to the exiting current of the old motor 112. Then, the process proceeds to step S116.

In step S116, the CPU 100 calculates a correction factor that fits the exiting period of the new motor 112 to the exiting period of the old motor 112. Thus, the process ends. The exiting period, which is obtained when the exiting current (the peak value observed when the sheet P exits from the fixing device 24) is detected, is calculated as the sum of the period of time taken for the average current with the sheet P to drop to the exiting current and the period of time taken for the exiting current to rise to the average current with no sheet P that is observed after the sheet P has exited from the fixing device 24.

In the present exemplary embodiment, the type of the sheet P is identified while the characteristic of the new motor 112 is corrected by using the correction factors calculated in the above correcting process. Therefore, the occurrence of misidentification of the type of the sheet P due to the difference between the characteristics of the old and new motors 112 is suppressed.

While the above exemplary embodiment concerns a case where the average current with no sheet P, the entering current, the exiting current, the entering period, the passing period, and the exiting period of the new motor 112 that are detected by the torque detecting unit 114 are fitted to the same items representing the characteristic of the old motor 112, the present invention is not limited to such a case. For example, only the average current with no sheet P or only the average current with no sheet P and the entering current may be taken as the characteristic of the motor 112. Moreover, any other combination of the above items or any other items that are not described above may be taken as the characteristic of the motor 112.

While the above exemplary embodiment concerns a case where the correcting process is performed if the motor 112 is replaced with a new one, the present invention is not limited to such a case. The characteristic of the motor 112 may change with, for example, quality deterioration over time. Therefore, the correcting process may be executed if any instruction for the execution of the correcting process is made on the operation display unit 110 when the operation display unit 110 is operated. In such a case, the characteristic of the load applied to the motor 112 that is taken as the reference may be stored in the process of manufacturing or installing the image forming apparatus 10 so that the characteristic may be read afterward. If the image forming apparatus 10 has experienced any replacement of the motor 112, the characteristic of the motor 112 at that replacement may be stored as the reference.

While the above exemplary embodiment concerns a case where the fixing device 24 is an exemplary transporting device, the present invention is not limited to such a case. For example, the present invention is also applicable to another transporting device in which the type of a sheet transported by a pair of transporting rollers is identified by detecting the load applied to a motor that drives the pair of transporting rollers.

While the above exemplary embodiment concerns a case where the process illustrated in FIG. 5 is performed by causing a computer to execute a transporting program, a part or the entirety of the process started with the execution of the transporting program may be performed by using hardware.

The process performed by the CPU 100 of the image forming apparatus 10 according to the above exemplary embodiment may be stored as a program in a storage medium and may be commercially distributed.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transporting device comprising:

a detecting portion that detects a load applied to a driving portion provided for transporting a medium;

an identifying portion that identifies a type of the medium from a result of detection performed by the detecting portion; and a correcting portion that, if a predetermined instruction is made, corrects the result of detection based on a predetermined reference characteristic of the load applied to the driving portion.

2. The transporting device according to claim 1, wherein, if an instruction indicating that the driving portion has been replaced with a new driving portion is made as the predetermined instruction, the correcting portion fits the result of detection obtained after the replacement to a characteristic of the load applied to the old driving portion as the predetermined reference characteristic.

3. The transporting device according to claim 1, wherein the predetermined reference characteristic includes an average of values of the load applied to the driving portion that are observed before the medium reaches a detection area where the detecting portion performs detection.

4. The transporting device according to claim 3, wherein the predetermined reference characteristic further includes a peak value of the load applied to the driving portion that is observed when a leading end of the medium enters the detection area.

5. The transporting device according to claim 4, wherein the predetermined reference characteristic further includes a peak value of the load applied to the driving portion that is observed when a trailing end of the medium exits from the detection area, a period over which a load indicating the entering of the leading end of the medium into the detection area is detected, a period over which a load indicating the exiting of the trailing end of the medium from the detection area is detected, and a period over which a load indicating that the medium is passing through the detection area is detected.

6. The transporting device according to claim 1, wherein after the correcting portion corrects the result of detection, the detecting portion detects a new load applied to the driving portion, and the identifying portion identifies a type of the medium from a result of the detection performed by the detecting portion based on the new load.

7. The transporting device according to claim 1, wherein the correcting portion corrects:

(i) a peak value of the load applied to the driving portion that is observed when a leading end of the medium enters a detection area where the detecting portion performs detection; and (ii) an average of values of the load applied to the driving portion that are observed before the medium reaches the detection area.

8. A fixing device comprising:

a fixing portion that fixes a toner image on a medium while the medium is transported by a driving portion provided for transporting the medium;

a detecting portion that detects a load applied to the driving portion;

an identifying portion that identifies a type of the medium from a result of detection performed by the detecting portion; and a correcting portion that, if a predetermined instruction is made, corrects the result of detection based on a predetermined reference characteristic of the load applied to the driving portion.

9. An image forming apparatus comprising:

an image forming portion that forms an image on a medium;

a driving portion that drives a pair of rotating bodies that nip and transport the medium;

a detecting portion that detects a load applied to the driving portion;

an identifying portion that identifies a type of the medium from a result of detection performed by the detecting portion; and a correcting portion that, if a predetermined instruction is made, corrects the result of detection based on a predetermined reference characteristic of the load applied to the driving portion.

* * * * *